US006405543B2

(12) United States Patent
Kopko

(10) Patent No.: US 6,405,543 B2
(45) Date of Patent: Jun. 18, 2002

(54) HIGH-EFFICIENCY AIR-CONDITIONING SYSTEM WITH HIGH-VOLUME AIR DISTRIBUTION

(75) Inventor: William L. Kopko, Springfield, VA (US)

(73) Assignee: Work Smart Energy Enterprises Inc., Washington, DC (US)

( * ) Notice: Subject to any disclaimer, the term of this patent is extended or adjusted under 35 U.S.C. 154(b) by 0 days.

(21) Appl. No.: 09/772,306

(22) Filed: Jan. 29, 2001

Related U.S. Application Data

(63) Continuation-in-part of application No. 09/331,758, filed on Jun. 25, 1999, now Pat. No. 6,185,943.

(51) Int. Cl.[7] ..... F25D 17/06

(52) U.S. Cl. ..... 62/89; 62/407; 62/97; 62/94

(58) Field of Search ..... 62/407, 89, 97, 62/94

(56) References Cited

U.S. PATENT DOCUMENTS

| | | | | | |
|---|---|---|---|---|---|
| 2,793,508 | A | * | 5/1957 | Mueller | 62/129 |
| 4,244,193 | A | * | 1/1981 | Haakenson | 62/180 |
| 4,497,182 | A | * | 2/1985 | Youngworth | 62/151 |
| 4,769,053 | A | * | 9/1988 | Fischer, Jr. | 55/389 |
| 5,179,998 | A | * | 1/1993 | Des Champs | 165/1 |
| 5,313,803 | A | * | 5/1994 | Detzer | 62/89 |
| 5,775,125 | A | * | 7/1998 | Sakai et al. | 62/410 |
| 5,890,372 | A | * | 4/1999 | Belding et al. | 62/271 |
| 5,996,354 | A | * | 12/1999 | Sokolean et al. | 62/80 |
| 6,021,644 | A | * | 2/2000 | Ares et al. | 62/151 |
| 6,185,943 | B1 | * | 2/2001 | Kopko | 62/89 |

* cited by examiner

*Primary Examiner*—William Doerrles
*Assistant Examiner*—Mark S Shulman
(74) *Attorney, Agent, or Firm*—Rothwell, Figg, Ernst & Manbak

(57) ABSTRACT

This invention provides a fundamentally new approach to air conditioning. In a conventional air-conditioning system air the full volume of air is cooled below the dew point to provide both sensible and latent cooling. In the new system, dehumidification and sensible cooling functions are preferably separate. The separate dehumidification allows for much higher supply air temperatures, preferably within about 10° F. of the space temperature. Low-velocity air distribution through a ceiling plenum or a vent into the space allows for very low fan static pressures, which greatly reduces fan energy use compared to conventional ducted systems. The low static pressures and high supply-air temperatures allow the use of existing drop ceiling construction with little modification. The system can also include low-cost thermal storage. Latent thermal storage is in the form of a concentrated liquid desiccant solution. Chilled water storage is another option. The result is a major improvement in energy efficiency and comfort while reducing installed cost and peak electrical demand of the system.

10 Claims, 5 Drawing Sheets

HIGH-EFFICIENCY AIR-CONDITIONING SYSTEM WITH HIGH-VOLUME AIR DISTRIBUTION

This application is a continuation-in-part of application Ser. No. 09/331,758 filed on Jun. 25, 1999 now U.S. Pat. No. 6,185,943.

BACKGROUND

Air-conditioning manufacturers, architects, and professional design engineers have expended huge efforts in optimizing the design of building air-conditioning systems. Annual sales of equipment amount to tens of billions of dollars and annual energy use for heating and cooling have similar values. In addition the costs associated with reduced productivity of workers because of uncomfortable environmental conditions may be several times these figures, although difficult to quantify. Yet despite this effort the fundamental process for air conditioning buildings has remained essentially the same since the introduction of the first air conditioners in the 1920's. Conventional approaches to air conditioning have inherent problems that severely limit their efficiency, raise installed cost, and frequently produce poor comfort conditions in the building space. Solving these problems requires major changes in the basic configuration of air-conditioning systems.

Conventional air-conditioning systems use a relatively small volume of air for cooling. The typical arrangement uses a vapor-compression refrigeration system to cool a mixture of return air and outside air to approximately 55° F. and then distribute the cooled air through ducts to the building space. The low supply air temperatures are a result of the need to cool air below its dew point to remove moisture. The low air temperatures are also necessary to meet the sensible cooling needs of the space without excessively large ducts.

There are several important problems with this approach. The first is related to fan energy use. Since air flow is through relatively restrictive ductwork, fan static pressures are quite high. Typical pressures range from less than 0.5 inches of water for residential systems to as much as 5 to 10 inches of water for large commercial cooling systems. These high static pressures result in large energy use from the fan, which also adds to the cooling load for the rest of the system. In many commercial systems, the fan heat accounts for as much as 20 to 30 percent of the total cooling load for the building. The net result is a very inefficient cooling system.

A second problem is with high compressor energy required. The low supply air temperatures mean even lower evaporating temperatures, typically 40 to 50 F for the compressor system. The low evaporating temperatures create more work for the compressor, which further reduces the efficiency of the system.

A third problem is poor indoor air quality associated with high duct humidity. Conditions over 70% relative humidity allow the growth of mold and fungus in ductwork. The relative humidity in the supply ducts for conventional systems is frequently over 90%. In addition water from wet coils wets drain pans and can also wet nearby ductwork. These wet conditions create a potential breeding grounds for many types of microbes that can cause health and odor problems.

A fourth issue is high noise levels with conventional systems. The high static pressure creates a need for a powerful fan that usually is quite noisy. In addition, metal ducts transmit the noise quite well. Common fixes for the noise problem include the use of fiberglass duct liners. Unfortunately these liners increase cost and pressure drop and also can contribute to problems with molds given the high relative humidity in most ducts.

A fifth problem is the potential for drafts with conventional cooling systems. The low supply air temperatures and high velocities create the possibility of extremely uncomfortable conditions near the vents. Designers must take special care to ensure adequate mixing of room air and supply air to reduce drafts to acceptable levels.

A sixth problem is the need for simultaneous heating and cooling. Most office buildings have a single air handling system for the interior and exterior zones. In cold weather the interior zones still need cooling because of heat from people, lights, equipment, etc., while the exterior needs heat. The usual solution is to supply cool air to the entire building in order to satisfy the cooling needs of the interior. Perimeter heaters or heaters in the ducts servicing the exterior zones then provide the heat necessary to satisfy the heating load and overcome the cooling from the supply air.

The objective of the present invention is to improve energy efficiency and to reduce or eliminate the problems associated with existing air conditioning systems.

SUMMARY OF THE INVENTION

The invention uses a fundamentally different approach to air conditioning. The approach involves the use of a large volumetric flow rate of air with a temperature that is close to that of the building space for space heating and cooling. A separate dehumidification system is used in humid climates. In one preferred embodiment, a ceiling plenum is used as for the supply air and air returns through the space. In another preferred embodiment, supply air enters the space through a vent near the ceiling along one wall and returns near the floor along the same wall. Pressure drops are kept very low because of the low air velocities. The low pressure and small temperature difference between the supply air and the room air allow for very low energy use and improved comfort.

DESCRIPTION OF THE INVENTION

Figure 1:
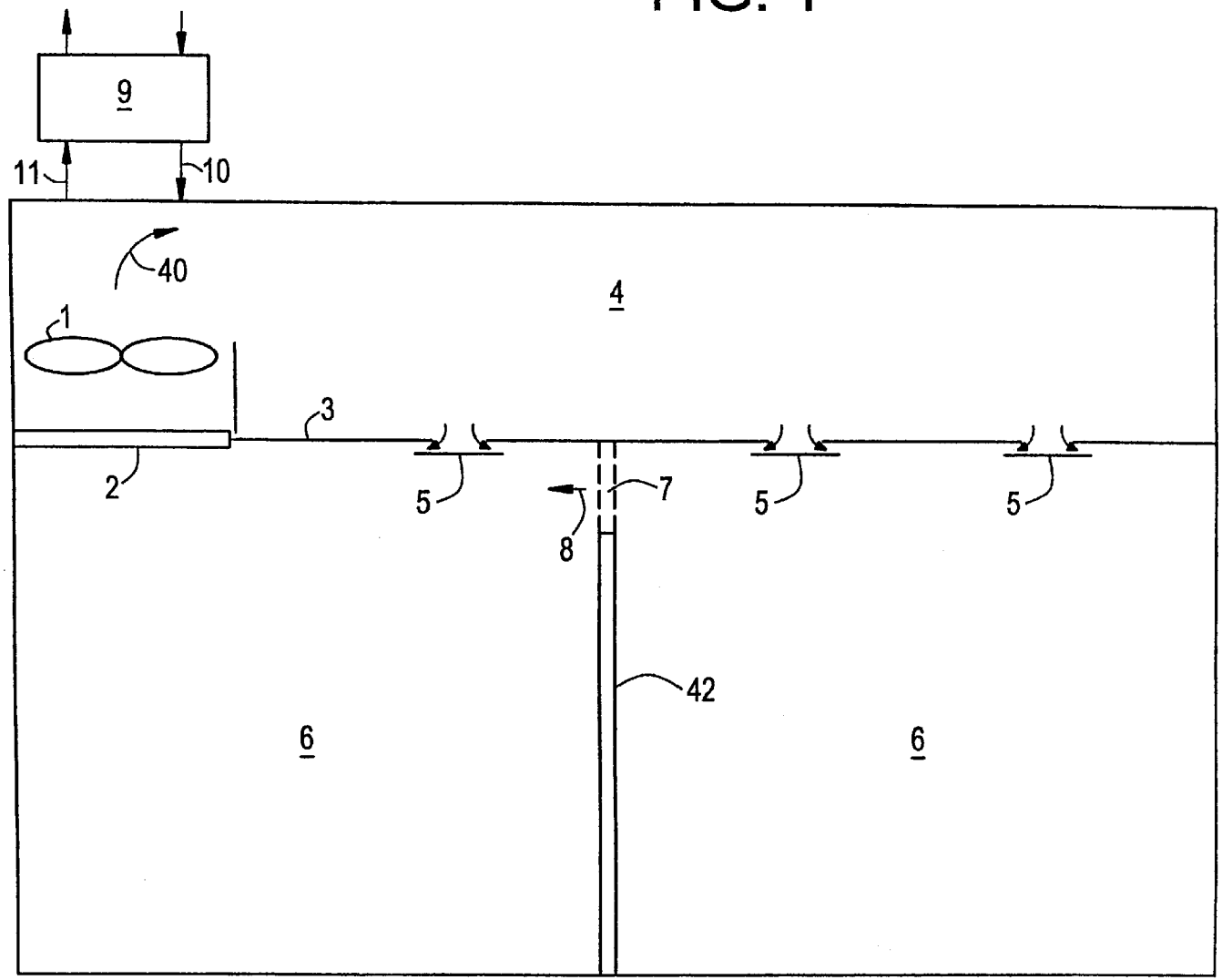
FIG. 1 shows a preferred embodiment that uses a ceiling plenum to distribute supply air.

Preferred embodiment: FIG. 1 shows a preferred embodiment of the invention. Fan, 1, draws air across coil, 2, where it is cooled or heated to create a supply air stream 40. Ceiling, 3, defines the bottom of a ceiling plenum, 4, that serves as a flow path for air leaving the fan. Vents, 5, provide openings into that allow supply air to mix with air in an occupied portion of the building space, 6. Vent, 7, provides an opening to allow air, 8, to return through a partition 42 in the space. A separate ventilation system, 9, provides dehumidified outside air, 10, to the space and recovers energy from exhaust air, 11.

The fan may be a propeller or centrifugal fan. It would have to provide only a small static pressure, typically less than 0.2 inches of water. The low static pressures favor the uses of low-speed fans, which should help to reduce fan sound levels and should reduce fan energy use.

The coil can contain water or brine or a refrigerant. The supply air temperature for cooling would normally be greater than about 63° F. and preferably about 68 to 70° F. The high temperatures prevent unwanted heat transfer through the ceiling and help to keep the relative humidity in the plenum below 70%. The coil temperature should be a least a few degrees above the dewpoint of the return air and preferably as close as practical to that of the supply air temperature. The high coil temperatures minimize the compressor energy required for cooling and eliminate problems associated with wet coils.

The ceiling would normally be a suspended ceiling. The tiles should sufficiently rigid to withstand the pressure of the plenum, which would normally be less the 0.1 inches of water. The low static pressures in the plenum reduce the loads on the tiles and reduce the problems associated with leaks around the edge of the tiles. The tiles should provide sufficient resistance to leakage and conduction to prevent undesirable heat transfer between the plenum and the space. In many cases, existing suspended ceilings would meet these requirements without any significant modification.

This configuration preferably uses very low velocities for the supply air compared to conventional duct systems. According to the *ASHRAE Handbook* 1985 *Fundamentals* for a conventional "low-velocity" duct with at least 10,000 CFM flow rate, the duct would have a velocity of 1300 to 2600 feet per minute. For the present invention at similar volumetric flow rates, the maximum supply air velocity would be less than about 1000 feet per minute and preferably about 100 to 400 feet per minute. This lower velocity is readily achievable because of the huge flow area available in a ceiling plenum compared to conventional ductwork. The low velocities assure low flow noise. They also provide very low pressure drops, which helps to assure proper air distribution to the entire building.

The vents, 5, are designed to handle a large volume of air with a minimal pressure drop, typically only a few hundredths of an inch of water. Adjustment may be manual or automatic. The vents should introduce sufficient mixing so as to prevent undesirable drafts.

Vents, 7, that allow air to move between zones should be able to handle the required airflow with pressure drops that are smaller than the pressure drop across the ceiling vents. In buildings with raised floors, another option is return air though the space under the floor.

Ideally the vents would have a control mechanism that is responsive to space temperature without need of a source of outside power. For example wax actuators and shape-memory actuators are capable of producing significant motion in response relatively small changes in space temperature and could be used to control air flow through the vents. Co-pending provisional U.S. application No. 60/077008 describes a roller damper mechanism that can work with these types of actuators.

While this drawing shows the ventilation air entering the ceiling plenum, the exact location where the air is added to the building is somewhat arbitrary, so long as the air temperature is close to that of the space. Likewise the exhaust air can be drawn from anywhere in the building and normally at least a portion would come from toilet exhaust. The ventilation/dehumidification system should incorporate an enthalpy wheel or other heat recovery device, and would preferably be a desiccant-based system capable of providing low dewpoints. The temperature of the air should be close to that of the building space, although this is not required if the air is mixed into the supply air. The ventilation system should also provide a small positive pressure for the building space to reduce possible of infiltration of outside air.

While the preferred dehumidification system is combined with a heat recovery ventilation system, many other configurations are possible. For example, the dehumidification system can simply further cool a portion of the air leaving the cooling coil so that its temperature drops below the dewpoint. A heat pipe or other device for exchanging heat between the air on the coil and the air leaving the coil can increase the amount of moisture remove compared to sensible cooling, which can reduce energy use. This arrangement is acceptable in cases where adequate outside air is available to the space from infiltration or other sources. Numerous other dehumidification systems that appear in the prior art could be used in the new system. The ASHRAE Handbooks describe many of these dehumidification options.

In dry climates the dehumidification system can be eliminated, although sensible heat recovery may still be a valuable option. There is also potential for eliminating the need for a compressor, with sensible cooling provided with an indirect evaporative cooler or cooling tower.

The table below shows the massive energy advantages of the invention when compared to a conventional air-conditioning system in handling the sensible cooling load:

Comparison of Energy Use for a Conventional Cooling System and New Invention

| | conventional | new high-flow | units |
|---|---|---|---|
| zone sensible load | 20 | 20 | btu/hr/ft2 |
| supply air temperature | 55 | 70 | deg F |
| room temperature | 75 | 77 | deg F |
| cfm/ton of total sensible load | 556 | 1587 | cfm/ton |
| fan static pressure | 6 | 0.2 | inches H2O |
| fan static efficiency | 70% | 50% | |
| motor efficiency | 90% | 80% | |
| fan power (hp/1000 CFM) | 1.349 | 0.063 | hp/1000 cfm |
| fan power (w/CFM) | 1.12 | 0.06 | w/cfm |
| fan heating | 3.53 | 0.19 | deg F |
| fan heat (% of sensible load) | 18% | 3% | |
| coil load | 23.5 | 20.5 | btu/hr/ft2 |
| chilled water temperature | 45 | 65 | deg F |
| chiller energy use | 0.6 | 0.3 | kw/coil ton |
| chiller energy use | 0.706 | 0.308 | kw/building ton |
| fan energy use | 0.528 | 0.091 | kw/building ton |
| total energy use | 1.234 | 0.399 | kw/building ton |
| percent energy saved | | 67.7% | |

This analysis shows that the new system can save over two thirds of the energy used for sensible cooling at design conditions. At off-design conditions the savings can be even larger because of the increased availability of free cooling because of the much high chilled water and supply air temperatures. This free cooling option means that the chiller may be shut down for a large portion of what is normally the cooling season.

The system should also have a major advantage in handling latent load. The use of an enthalpy wheel or other suitable heat exchanger can reduce loads associated with bringing in outside air by 80%. Heat recovery also greatly reduces heating requirements. For most office and retail buildings, the outside air is the main source of moisture. Use of a gas-driven desiccant system also gives the opportunity to greatly reduce electric demand charges while efficiently handling the ventilation load. Electrically driven systems are also an option.

Use of a separate dehumidification system also greatly reduces the need to run the whole system when the building is unoccupied. Current systems frequently require continuous operation during conditions of high humidity in order to prevent excessive accumulation of moisture in building materials during off periods. The present invention allows the operation of the dehumidification system alone, which greatly reduces operating costs while providing good moisture control.

Figure 2:
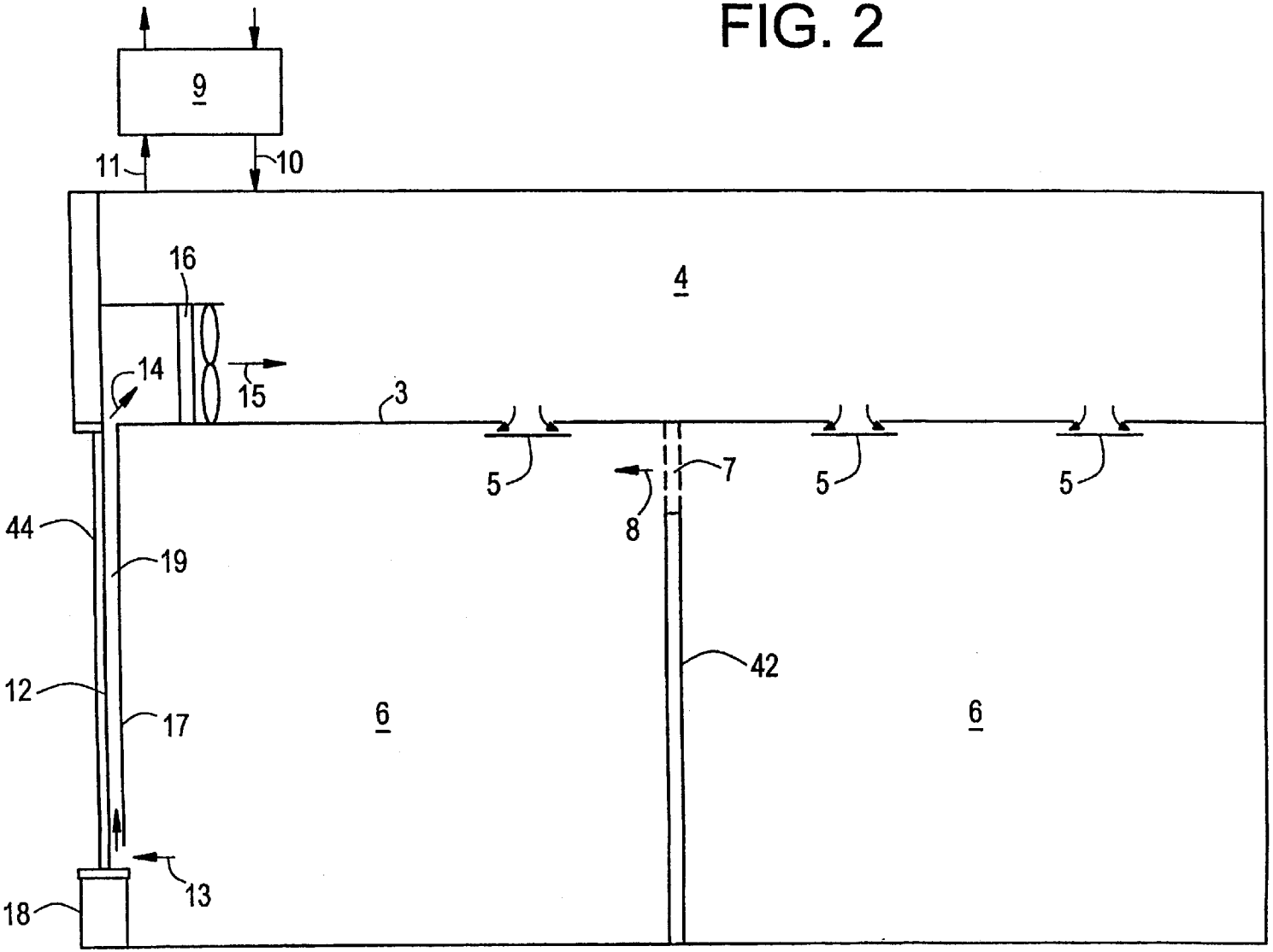
FIG. 2 is a preferred embodiment that returns air through a channel in a window.

Embodiment with Alternate Return-Air Configuration: FIG. 2 shows a variation of the first embodiment that is designed to greatly reduce the need for heating. The basic idea is to move a large volume of air from the interior toward the exterior of the building. The system also draws return air from the building envelope. Return air, 13, is drawn upward through channel, 19, that is formed between exterior glazing, 12, and interior glazing, 17 of a window 44. This arrangement effectively removes any cold air associated with heat loss through glazing, 12 and an exterior wall, 18. The return air then moves into channel, 14. Fan, 15, draws air from the channel through coil, 16, and then discharges the conditioned air into the ceiling plenum 4 as a supply air stream 41.

This configuration several advantages that greatly reduce winter heating requirements. The first is that it removes cold from the building envelop before it enters the conditioned space. The second is that it then moves this air toward the interior so as to provide necessary cooling. Third it then uses the air returning from the interior to provide as source of warm air for the exterior zones. This system should not require any significant amount of heat so long as the interior heat generation exceeds the exterior heating load. Proper insulation of windows and walls can effectively eliminate the need for heat in most larger buildings even in the most severe climates. The only time that heat would normally be required, would be if the building were unoccupied for a long period of time with limited sunlight. Under these circumstances, the coils provide heat to warm the entire building.

Figure 3:
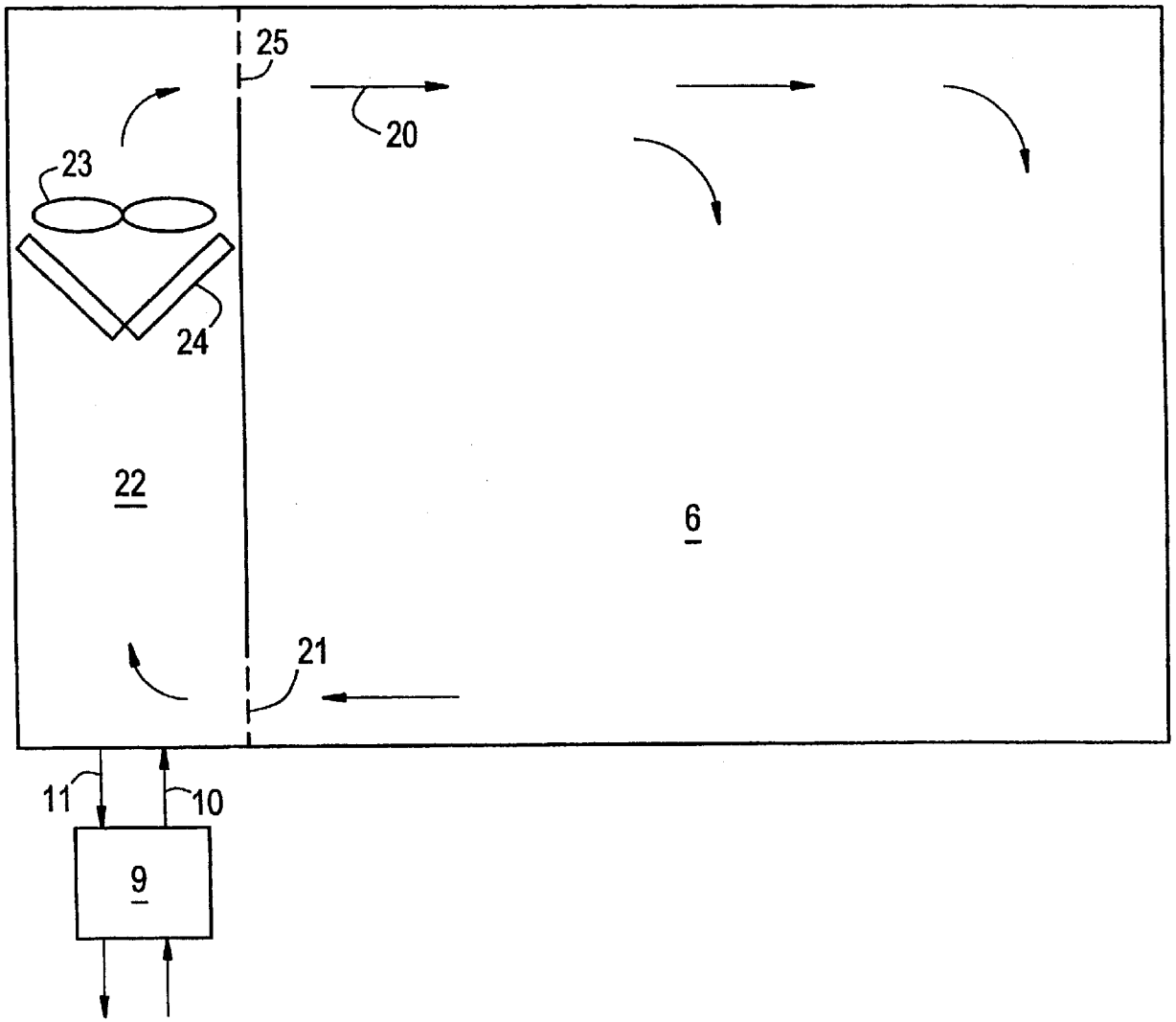
FIG. 3 is a preferred embodiment for buildings without ceiling plenum.

FIG. 3 shows a third preferred embodiment of the invention. This configuration is suitable in retail space or similar applications with large open areas and few obstructions near the ceiling. Fan, 23, moves supply air, 20, from coil, 24, through vent, 25, to mix with air in building space, 6. The air returns through register, 21, and return duct, 22, back to coil, 24. As with the other embodiments, a separate dehumidification system supplies outside air and recovers heat from exhaust air.

A key feature of this embodiment is the combination of high air volume, high temperature, low velocity, and low relative humidity of the supply air compared to conventional systems. The preferred velocity of the air flowing through the vent is low, less than 1000 feet per minute and preferably about 100 to 500 feet per minute. The air volume flow requirements are large, typically over twice that of convention systems per unit of cooling capacity, which corresponds to at least 10,000 CFM for a small commercial building (5 to 10-ton load). For a typical retail building (50,000 to 100,000 square feet) the volumetric flow rate amounts to over 100,000 CFM. A preferred supply air temperature is high, at least about 63° F. and preferably 68 to 70° F. The relative humidity of the supply air is low compared to conventional systems, less than about 90 percent and preferably about 75 percent or lower. The combination of low velocity, high air volumetric flow rate, and high supply air temperature allows for a very long throw of 100 feet or more without risk of cold, high-velocity drafts. The low relative humidity of the supply air assures proper humidity control in the space. These supply-air conditions provide comfort in the building space in addition to providing great opportunities for energy savings.

The large volumetric flow rates and relatively warm temperatures of the supply air allow for very long throws that may be necessary to supply air to a large space. The higher supply temperatures also greatly reduce the risk of uncomfortable drafts in the space. As with the other embodiments, this system has a large advantage in efficiency because of the high coil temperatures and low fan static pressures. It should have a major first cost advantage since it virtually eliminates the need for ductwork. One disadvantage is that it does not provide local temperature control within the building space, which may limit its application.

Figure 4:
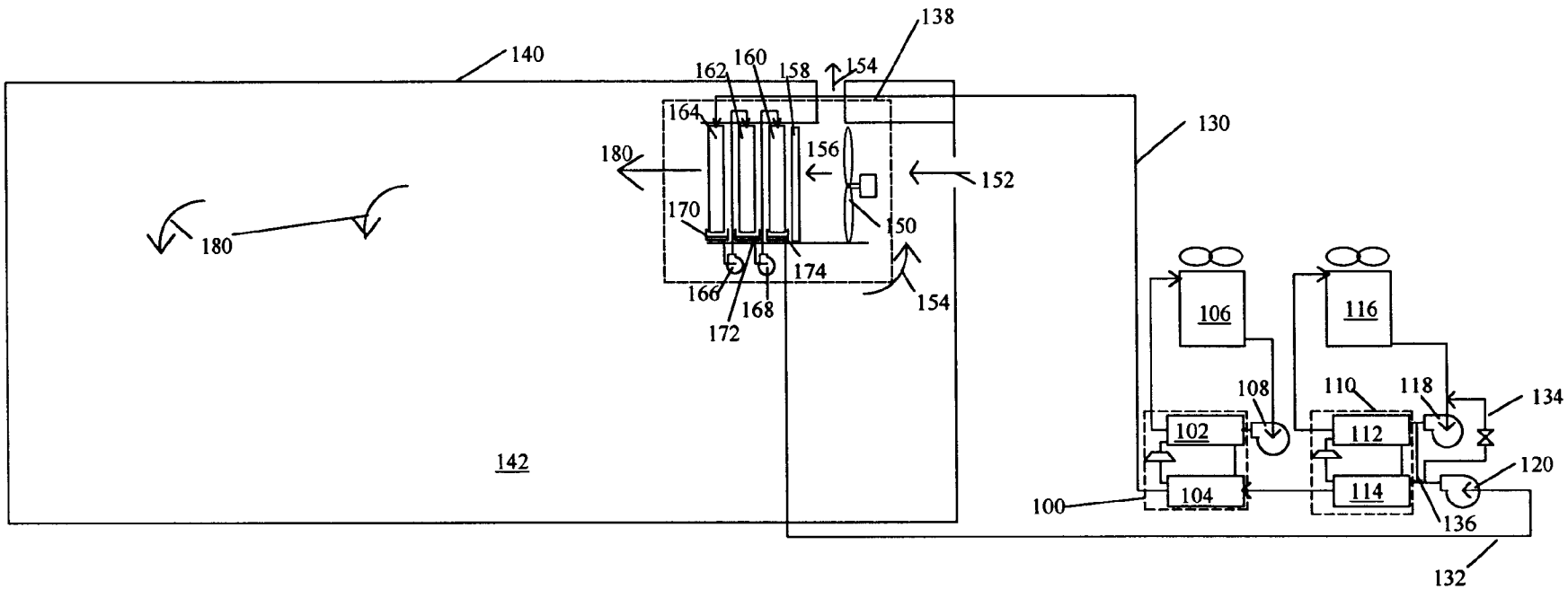
FIG. 4 is an alternate embodiment that uses a cooled liquid desiccant for both cooling and dehumidification.

Cooled-Desiccant Embodiment: FIG. 4 shows an embodiment that uses a cooled liquid desiccant for both cooling and dehumidification for comfort air conditioning in a building 140. This embodiment uses two chillers. A water-cooled chiller 100 includes a water-cooled condenser 102 and a desiccant cooler 104. A condenser water pump circulates cooling water through the condenser 102 to a cooling tower 106.

The second chiller is a desiccant-cooled chiller, 110. It comprises a desiccant-cooled condenser 112 and a desiccant cooler 114. A condenser pump 118 circulates a liquid desiccant through the condenser to a cooling tower 116. The waste heat from the condenser cools heats the desiccant fluid, which cause water to evaporate out of the desiccant and creates concentrated desiccant. The desiccant cooling tower should be of special design to ensure material compatibility and prevent excessive loss of desiccant material.

A desiccant loop provides sensible and latent cooling to a building 140. The desiccant loop comprises a cooled-desiccant pump 120 the pumps desiccant through the desiccant coolers 114 and 104. A supply desiccant line 130 supplies the cooled desiccant to an air handler 138. A return desiccant line 132 returns the desiccant from the air handler to the cooled-desiccant pump 120 to complete the loop.

The air handler 138 uses cooled desiccant to cooled and dehumidify a mixed air stream 156. The mixed-air stream 156 is a mixture of outside air 152 and return air 154 that is moved by a fan 150. A portion of the mixed-air stream leaves the building as exhaust air 154. The remaining mixed-air stream enters a filter 158 and then goes through a first, second, and third direct-contact heat exchangers 160, 162, and 164 respectively. The direct-contact heat exchangers allow simultaneous heat and mass transfer between the air and the cooled desiccant and are preferably arranged in a counter-crossflow configuration.

The first direct-contact heat exchanger receives desiccant from a first sump pump 168. A first sump 174 collects desiccant that drains off of the first direct-contact heat exchanger. Likewise the second direct-contact heat exchanger receives desiccant from a second sump pump 166 and has a second sump 172. The desiccant collected in the second sump 172 supplies the first sump pump 168. A third direct-contact heat exchanger 164 receives desiccant from the supply desiccant line 130. Air flows through the first then the second and the third direct-contact heat exchangers so as to approximate a couterflow configuration. This setup allows for a close approach temperature. While three passes of cooling are shown in FIG. 4, other numbers a possible and may be desirable depending on the details of the design of the air handler. The preferred number is between 1 and 5 passes.

A supply air stream 180 exits in an approximately horizontal direction from the air handler 138. As with the previous embodiments as for example FIG. 3, the supply air has a relatively high temperature, low speed, and low relative humidity compared to conventional designs. The preferred values for these conditions are similar to those for the earlier embodiments. The supply air stream gradually slows as it moves away from the air handler and mixes into the air in an occupied portion 142 of the building 140.

The preferred desiccant material is calcium chloride, although other materials such as various glycols, lithium chloride, or lithium bromide are possible. The advantages of calcium chloride include its low-cost, availability, and very low toxicity. Its long history of use as a brine for refrigeration applications means that compatibility with materials of construction is well known. Because the required relative humidity is relatively high (about 70%) compared to the low values required in most other desiccant applications (typically about 30% or less), the relatively high equilibrium vapor pressure of calcium chloride solutions is not a problem.

Figure 5:
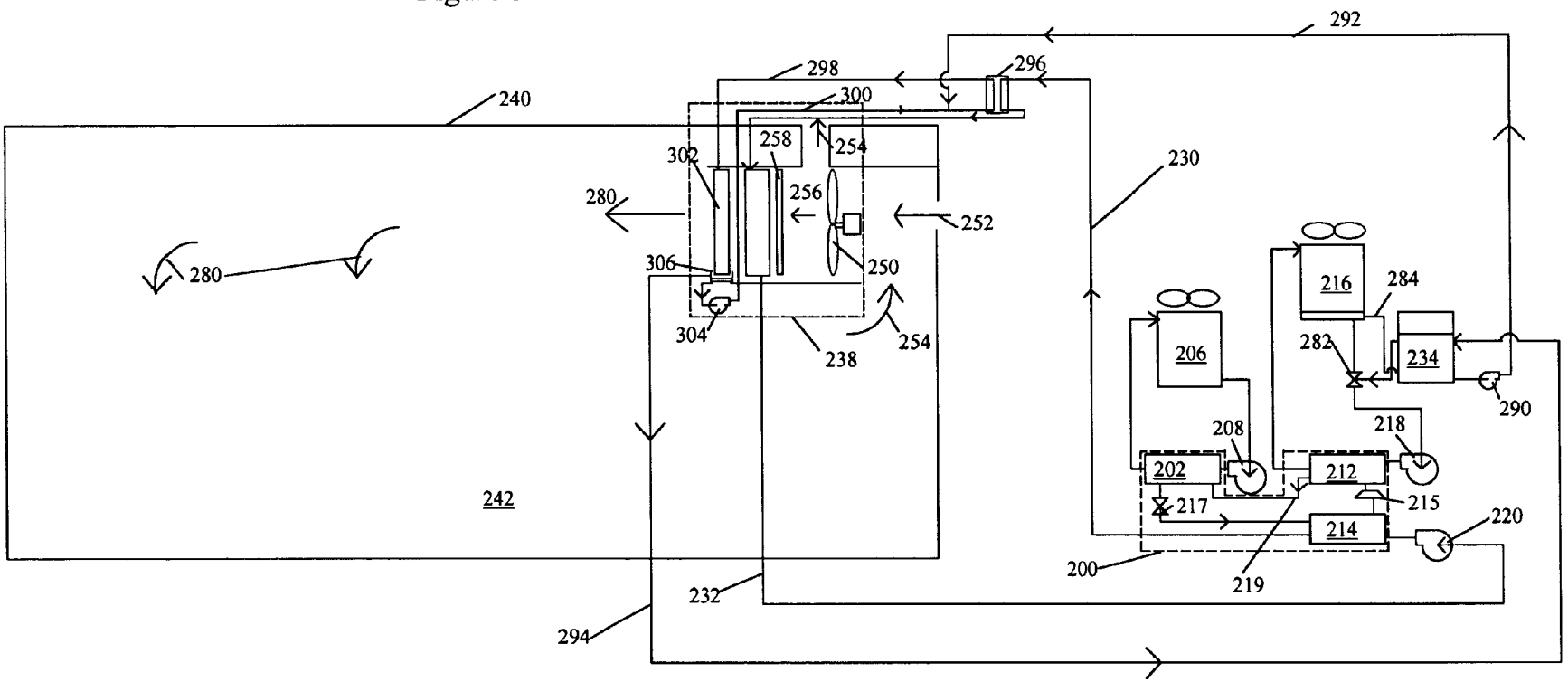
FIG. 5 is another alternate embodiment that uses liquid desiccant for dehumidification.

Alternate liquid desiccant embodiment: FIG. 5 shows an embodiment with liquid-desiccant dehumidification with a single chiller. The chiller 200 comprises a liquid cooler 214 that evaporates refrigerant and supplies refrigerant vapor to a compressor 215. While the chiller is shown outside, it can also be located inside a building to be cooled. The discharge of the compressor goes into an auxiliary condenser 212 the heats desiccant. The refrigerant leaving the auxiliary condenser then goes into a main condenser 202 that exchanges heat with condenser water. Liquid refrigerant leaves the main condenser through a liquid line 217 that includes valve, orifice, or other pressure drop.

The main condenser is part of a cooling tower loop. A condenser-water pump 208 moves water through the condenser to a cooling tower 206, which normally cools the water by evaporation into the atmosphere. Dry cooling towers are also an option.

The auxiliary condenser is used to heat liquid desiccant. A desiccant pump 218 move desiccant through the auxiliary condenser to a direct-contact heat exchanger 216 that is a type of cooling tower. The direct-contact heat exchanger evaporates water from the warm desiccant. The majority of desiccant leaving the heat exchanger returns through a control valve 282 to the desiccant pump. The rest goes through line 284 to a desiccant storage tank 234. The desiccant storage tank keeps a supply of desiccant for dehumidification when the auxiliary condenser is not operating.

The operation of the condenser pumps allows for efficient production of chilled water and concentrated desiccant. To produce concentrated desiccant, the chiller is run with the desiccant pump 218 is on, and the condenser water pump 208 turned off. The chiller then runs with a relatively high condensing temperature (about 100 to 130° F.) to regenerate the desiccant. When additional concentrated desiccant is not required, the desiccant pump is turned off; and the condenser water pump 208 is turned on, which allows the chiller to run with a lower condensing temperature (typically less than 105° F.). When no chilled water is required, the chiller is turned off. While FIG. 5 shows a series refrigerant flow configuration for the condensers, the condensers can also share a common shell (shellside refrigerant) with separate tube bundles and liquid connections.

The storage tank is preferably sized to provide desiccant for at least an hour or two of operation. Storage capacity with at 8 to 12 hours of storage allows for significant demand shifting. The volume of storage required is small since because the desiccant uses the heat of vaporization of water as the storage mechanism. Latent energy storage of several hundred Btu/lbm is possible. The storage capacity of the desiccant related primarily to concentration of solution, not temperature, so insulation of the tank is not normally required.

A desiccant pump 290 draws desiccant from the bottom of the storage tank, which normally contains the most-concentrated desiccant, and move the desiccant through a desiccant supply line 292. The desiccant supply line adds concentrated desiccant to a warm desiccant line 300 that is part of fluid circuit includes a direct-contact heat exchanger 302 in an air handler 238. The warm desiccant flows into a heat exchanger 296 that cools the desiccant using chilled water. The desiccant then flows through a cooled-desiccant line 298 to the direct-contact heat exchanger 302. A sump 306 collects warm desiccant from the direct-contact heat changer 302. Most of the desiccant then enters a desiccant pump 304 that pumps it through the warm-desiccant line 300 to complete the loop. A portion of the desiccant drains from the sump 306 through a diluted-desiccant line 294, which returns it to the desiccant storage tank 234, preferably at a location near the top liquid in the tank.

The air handler 238 also comprises fan 250 and a coil 260. The fan 250 draws return air 254 and outside air 252 into the air handler. A portion of a mixed air stream 256 leaving the fan exits as an exhaust air stream 254. The rest of the air stream goes through a filter 258 to a coil 260 and then through the direct-contact heat exchanger 302, which dries the air with the desiccant. The air leave the air handler as a supply air stream 280, which flows in a roughly horizontal direction at low speed as in the earlier embodiments. The supply air 280 mixes with air in an occupied portion of a building space 242.

Cooling water from the coil come from the chiller. A chilled water supply line 230 leaves the water cooler 214 and enters the heat exchanger 296 that cools the desiccant. The chilled water then enters the coil 260 and returns to a chilled-water pump 220 through return line 232. The chilled-water pump 220 pumps the water through the cooler 214 to complete the chilled-water circuit.

Some features can be changed while keeping the basic function of the system. For example, the heat exchanger 296 for cooling desiccant can be eliminated. Another possibility is to place the desiccant upstream of the cooling coil. These changes would increase the desiccant concentration and lower chilled water temperature necessary to achieve a given supply air temperature and relative humidity. Another possibility is to uses the auxiliary condenser as a desuperheater that operates at the same time as the main condenser. This change is possible with refrigerants that produce a high discharge temperature, such as R-22, but it is not normally an option with R-123, which has little superheat. While the chiller and associated equipment is shown outside, it can also be located inside the building to be cooled or in a separate structure.

Yet another option is to incorporate a heat-recovery heat exchanger or enthalpy recovery wheel to reduce ventilation energy requirements. This approach reduces energy use, but may be feasible in every case depending on the ability to economically recover energy from the exhaust air. These changes or similar changes or combinations of changes do not affect the basic function of the system Other possible configurations: There are many possible variations of these embodiments. For example, through not preferred, a conventional heat-pipe reheat system with air cooled below the dewpoint can provide similar supply-air conditions. Mixing return air and supply air to achieve a high supply air temperature is also an option, though not preferred.

Other systems for regenerating desiccant using heat from combustion or heat from solar energy is another option. The solar option is explore more fully in a co-pending application entitled, "Solar air conditioner." Other configurations of chillers or heat pumps are also possible for supplying heat to regenerate a desiccant.

Thermal storage using chilled water is another possibility. This option is discussed in a co-pending application entitled, "Air conditioner with thermal storage."

Summary of the Advantages: To sum up, here are the advantages of the invention:

1. reduced fan energy,
2. less compressor energy,
3. less ductwork required,
4. smaller space requirements,
5. reduced heating requirements,
6. individual room control possible,
7. dry coils (reduced maintenance),
8. better indoor air quality,
9. low noise,
10. no cold drafts,
11. increased economizer use possible
12. ability to use thermal storage for demand shifting, and
13. efficient dehumidification using liquid desiccant.

I claim:

1. A method for air conditioning a building space comprising:

Cooling, dehumidifying, and blowing air to produce a supply air stream with a volumetric flow rate of at least about 5000 cubic feet per minute with a temperature that is above about 63° F. with a relative humidity of less than 90%;

Supplying said supply air stream in an approximately horizontal direction above an occupied portion of the building space at a maximum speed of less than about 1000 feet per minute; and Mixing air from said supply air stream into air in the occupied portion of said building space.

2. The method for air conditioning a building space of claim 1 further comprising drawing at least a portion of air that is cooled to produce said supply air stream as a return air stream from the occupied portion of said building space.

3. The method for air conditioning a building space of claim 2 wherein said supply temperature is at least about 67° F.

4. The method for air conditioning a building space of claim 3 wherein the air speed is less than about 500 feet per minute.

5. The method for air conditioning a building space of claim 4 wherein the supply relative humidity is less than about 75 percent.

6. The method for air conditioning a building space of claim 5 wherein the method of supplying air comprises supplying air through a ceiling plenum to vents in a suspended ceiling, and then into the building space.

7. The method for air conditioning a building space of claim 5 wherein the method of supplying air comprises delivering air to said building space in an approximately horizontal direction through a vent located above the occupied portion of said building space.

8. The method of claim 1 wherein said dehumidifying is accomplished by direct contact between air and a liquid desiccant.

9. The method of claim 8 further comprising cooling said liquid desiccant.

10. The method of claim 8 further comprising regenerating said desiccant using heat from a condenser.

* * * * *